US007895783B1

(12) United States Patent
Espejo

(10) Patent No.: US 7,895,783 B1
(45) Date of Patent: Mar. 1, 2011

(54) MULTI-MEDIA DISPLAY SYSTEM

(76) Inventor: Eric Espejo, Long Beach, CA (US)

( * ) Notice: Subject to any disclaimer, the term of this patent is extended or adjusted under 35 U.S.C. 154(b) by 1188 days.

(21) Appl. No.: 11/540,127

(22) Filed: Sep. 29, 2006

Related U.S. Application Data

(60) Provisional application No. 60/722,545, filed on Sep. 30, 2005.

(51) Int. Cl.
*G09F 15/00* (2006.01)

(52) U.S. Cl. ..... 40/606.19; 248/121; 248/27.8; 248/519

(58) Field of Classification Search ..... 40/645, 40/606.03, 606.01, 607.01; 248/27.8, 127, 248/158, 519, 121
See application file for complete search history.

(56) References Cited

U.S. PATENT DOCUMENTS

| | | | | |
|---|---|---|---|---|
| 502,559 | A | 8/1893 | Gilman | |
| 1,808,292 | A * | 6/1931 | Coppersmith | 40/645 |
| D117,348 | S | 10/1939 | Cutter | |
| D166,925 | S | 6/1952 | Roop | |
| 2,792,142 | A | 5/1957 | Sandkuhle et al. | |
| 3,955,320 | A | 5/1976 | Serovy et al. | |
| D304,811 | S | 11/1989 | Thurman | |
| D346,605 | S | 5/1994 | Bosson | |
| D373,584 | S | 9/1996 | Anand | |
| D383,707 | S | 9/1997 | Waszkiewicz, III | |
| D392,914 | S | 3/1998 | Friend | |
| 5,844,181 | A | 12/1998 | Amo et al. | |
| 5,870,856 | A | 2/1999 | Friend | |
| D423,822 | S | 5/2000 | Takemasa | |
| 6,215,411 | B1 | 4/2001 | Gothard | |
| D455,131 | S | 4/2002 | Reynaga et al. | |
| 6,384,736 | B1 | 5/2002 | Gothard | |
| D458,560 | S | 6/2002 | D'Hulst | |
| 6,564,490 | B1 * | 5/2003 | Avila | 40/745 |
| D475,854 | S | 6/2003 | Caponey | |
| D480,326 | S | 10/2003 | Carlson | |
| D482,016 | S | 11/2003 | Howe et al. | |
| D488,401 | S | 4/2004 | Gutierrez | |
| D528,940 | S | 9/2006 | Espejo | |
| 2003/0163369 | A1 | 8/2003 | Arr | |
| 2003/0235054 | A1 * | 12/2003 | Ruggles | 362/431 |
| 2005/0263659 | A1 * | 12/2005 | Pfister et al. | 248/289.11 |
| 2009/0033886 | A1 * | 2/2009 | Jones | 353/94 |

FOREIGN PATENT DOCUMENTS

CN 201032138 Y * 3/2008

* cited by examiner

*Primary Examiner* — Cassandra Davis
(74) *Attorney, Agent, or Firm* — Advantage IP Law Firm

(57) ABSTRACT

A multi-media display system having a base surrounding a portion of and cooperating with an upstanding support tower to provide a mounting system for a number of components including at least one display device, audio output components, alternative display frames, backlighting components, and a pre-selected group of concealment features to provide a multi-media presentation system capable of blending into the environment of the locale in which the system is situated.

19 Claims, 10 Drawing Sheets

118
98a
120
8D
106a
108
68

98a
107a
108

107a
98a
100a
100c
107b
8C
106a
68
75
73d
106b
73c
73e
74
24

98a
110
100c
68
24
116
112
75
70
100a
114

MULTI-MEDIA DISPLAY SYSTEM

This application claims the benefit of provisional application U.S. Ser. No. 60/722,545, filed on Sep. 30, 2005, entitled Multi-media Display System, which is hereby incorporated by reference in its entirety.

BACKGROUND OF THE INVENTION

1. Field of the Invention

The present invention relates generally to advertising displays and more specifically to multi-media advertising display stands or kiosks.

2. General Background and State of the Art

Advertisements appearing in locations such as shopping mall venues, airport shops, restaurants, bowling alleys and other locales having either a common area or an area designated for advertising come in many forms. Typically, in-store advertising is provided in the form of hanging signs, window displays, poster stands, and wall posters disposed about the store. These devices are static and need to be replaced when the information changes such as the ending of a sale or change in merchandise. In addition, such static forms of advertising do not always catch the attention of the shopper or prospective buyer. The use of enlarged lettering, startling colors, and nearby blinking lights is common methods to increase the likelihood of the advertisement being observed by the potential customer. However, such devices are not typically constructed to blend into the store's surrounding but instead stand out and thus may not be aesthetically pleasing. Some stores, particularly clothing stores, have been known to incorporate a wall of televisions to provide an ambience in the store such as by playing popular videos or commercials for the in-store products. However, such a wall of televisions is usually out of place with the motif of the store and more often than not the videos have nothing to do with the merchandise.

Outside the stores in common areas, advertising is typically provided by a poster stand near a directory. These posters may be backlighted and more sophisticated stands allow for two or three posters to be shown in the same display window by rotating the posters on a conveyor or using a reversible shutter system. In addition, the flexibility to advertise for more than one retailer is necessary to accommodate multiple tenants but such devices suffer from lack of advertising space. Both the stores and common areas may have conflicting themes or motifs that may have to be accommodated by the advertising devices. Typically, a bland, neutral approach is taken to try to accommodate multiple parties but this approach results in doing little to add to the decorum of the locale.

While the above described advertising devices have their uses, they generally suffer from being static in nature, requiring extensive efforts to upkeep fresh content and thus somewhat costly to maintain, creating a blight on the surrounding environment, and from being resistant to relocation. Thus, there exists a need for an attractive multi-media advertising display system capable of blending into a surrounding environment while providing fresh transitional advertising that may be readily tailored to both individual and multiple settings as well as facilitate relocation.

DETAILED DESCRIPTION OF THE PREFERRED EMBODIMENTS

Figure 1:
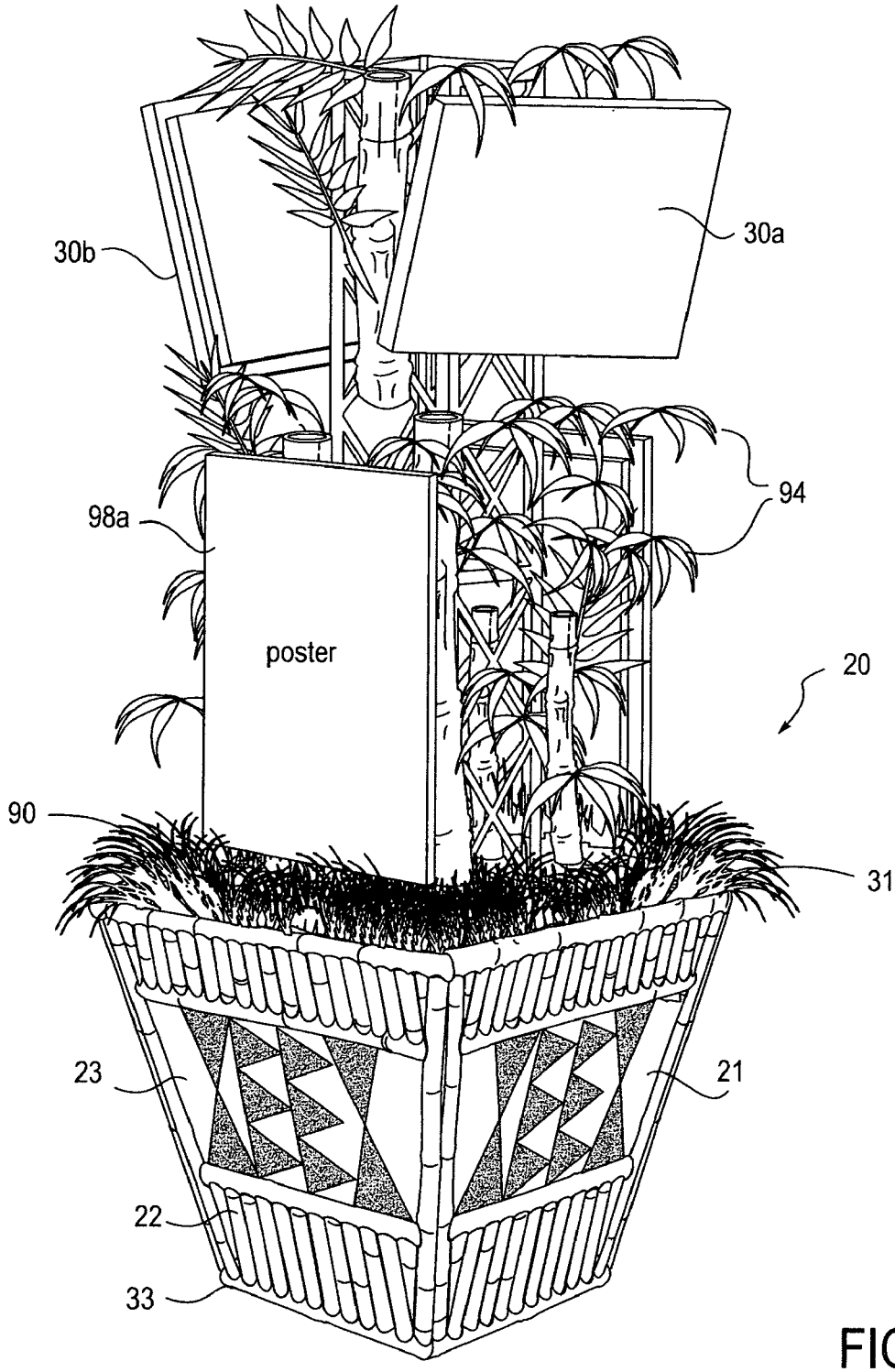
FIG. 1 is a forward left perspective view of a multi-media display system in accordance with one embodiment of the present invention.
Figure 2:
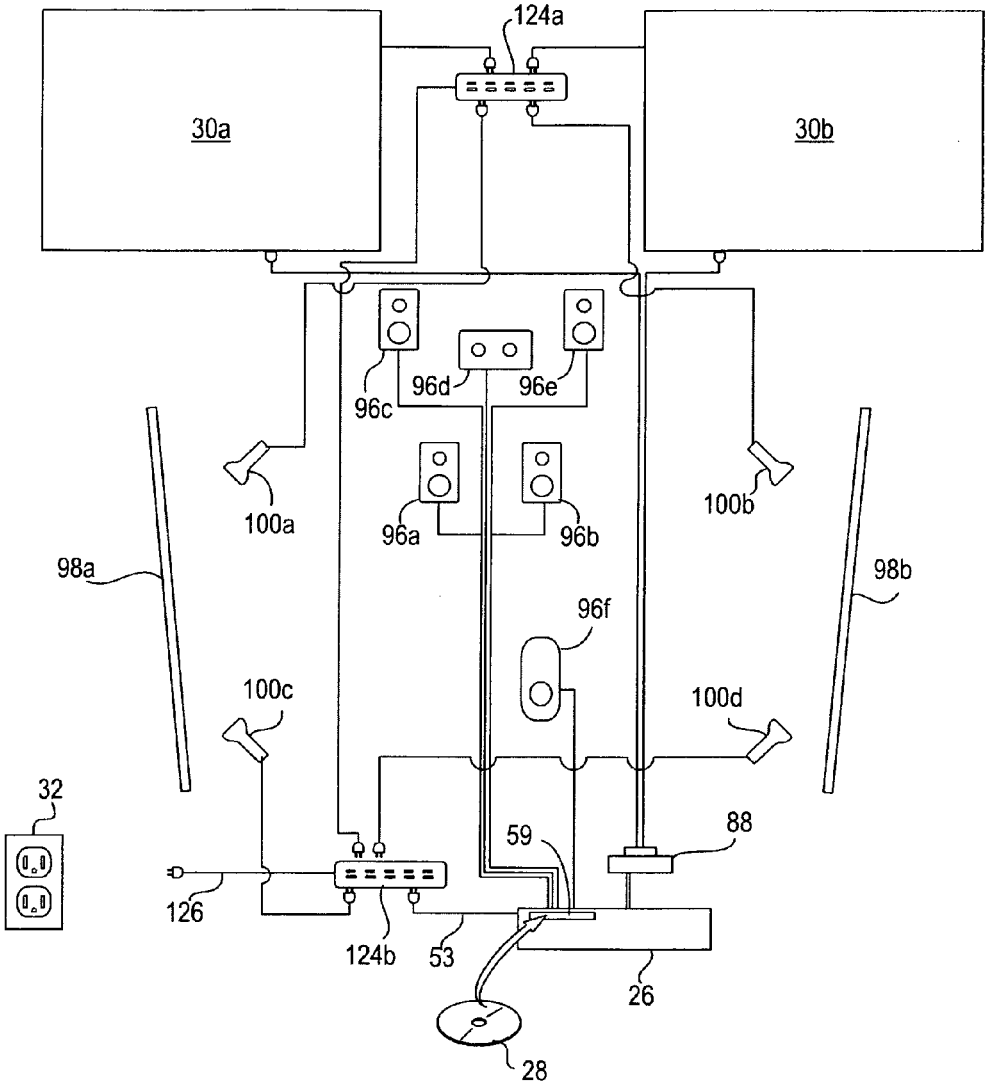
FIG. 2 is a block diagram of the audio visual system and advertising components used in conjunction with the display system of FIG. 1.

Referring now to FIGS. 1-2, an exemplary multi-media display system constructed in accordance with the present invention is illustrated. The multi-media display system, generally designated 20, has a base 22, a support tower 24, a multi-media playback device 26 capable of playing an audio-visual recording 28, at least one display device 30*a*, 30*b*, and a power source 32. The display tower may also include several additional optional features including concealment devices as discussed below to enhance the operability of the display system while providing the option to blend the display system into the surrounding environment.

Figure 3:
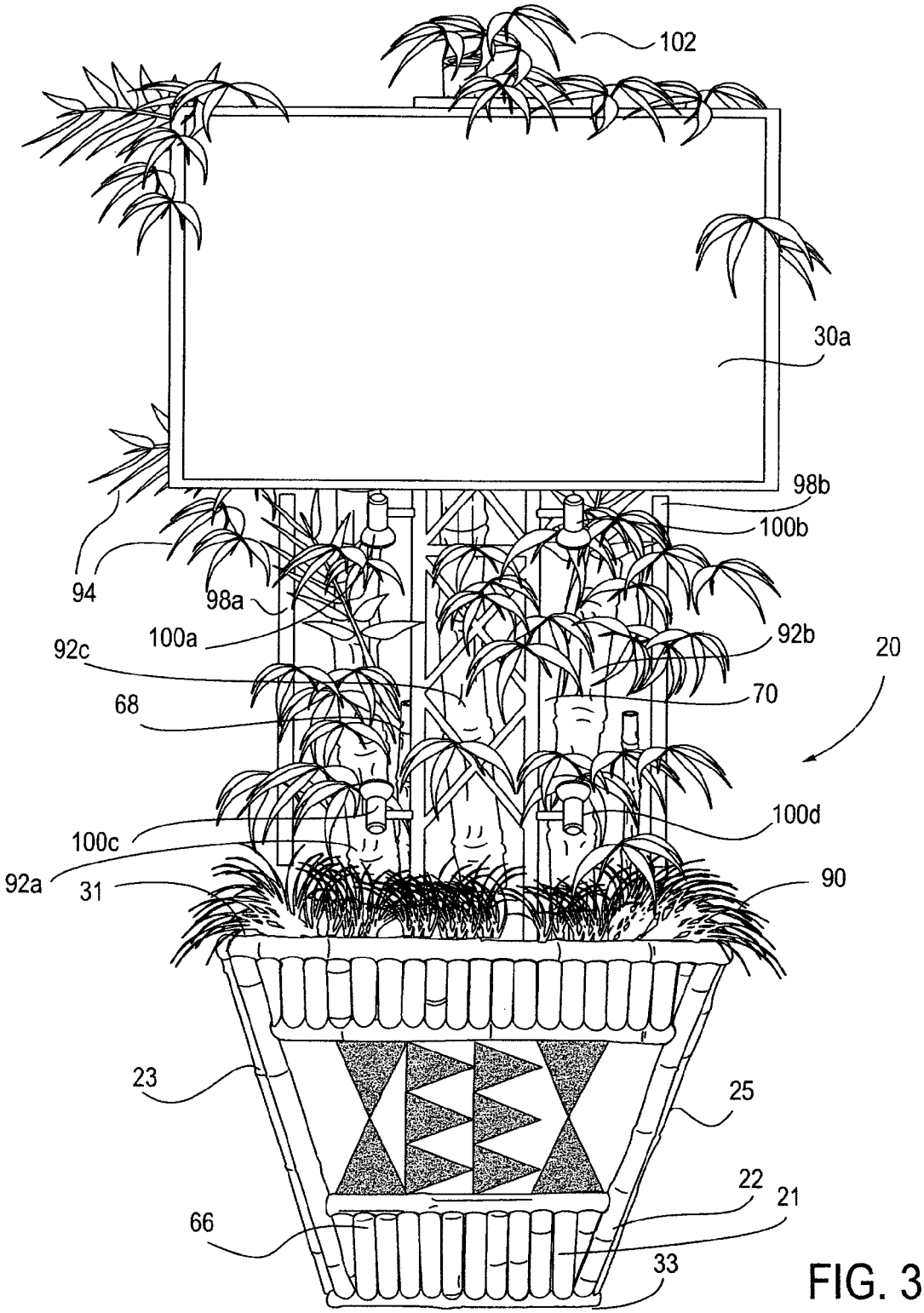
FIG. 3 is front view of the display system of FIG. 1 with concealment features in the form of artificial foliage.
Figure 4:
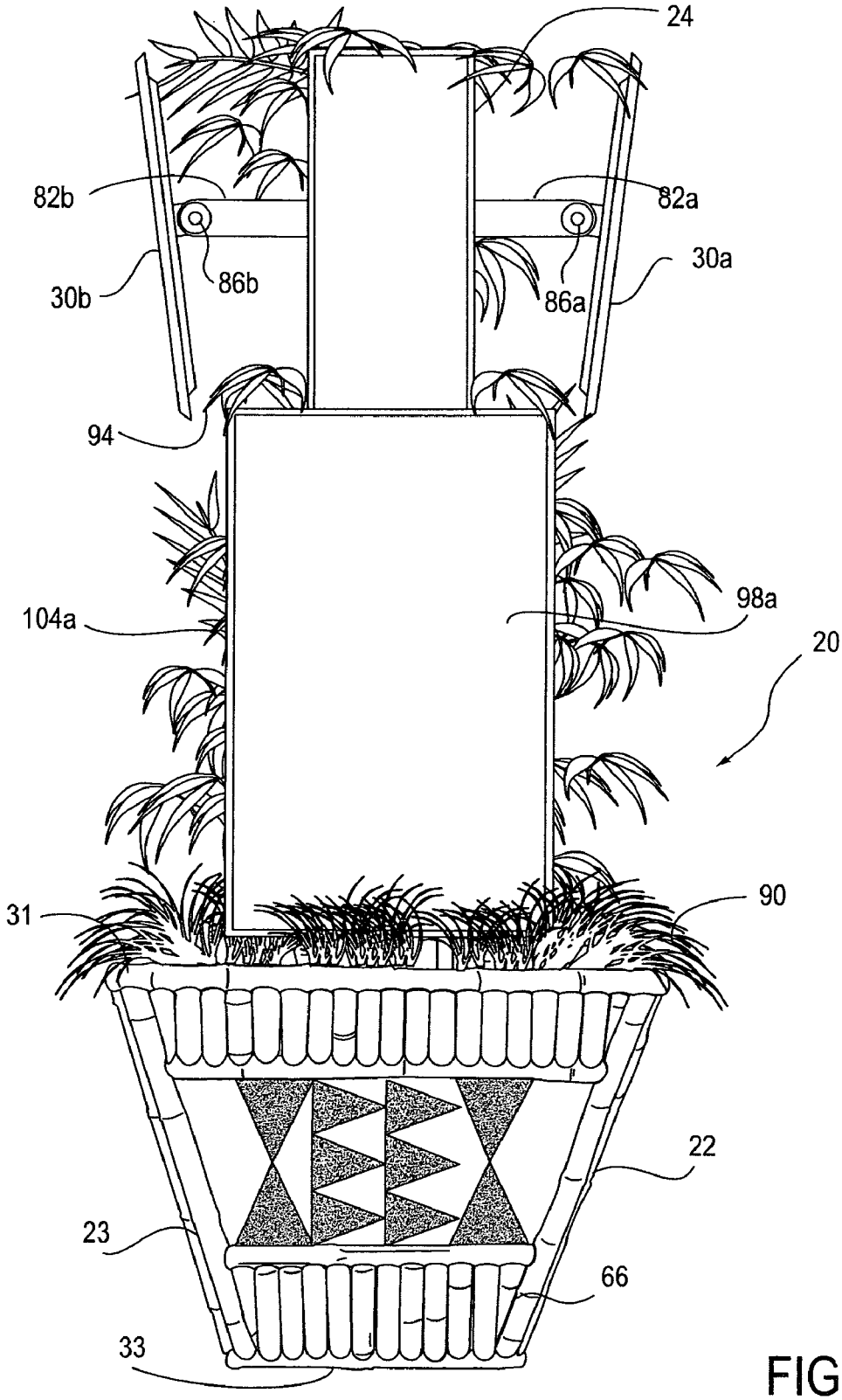
FIG. 4 is a left hand end view of the display system of FIG. 1.
Figure 5B:
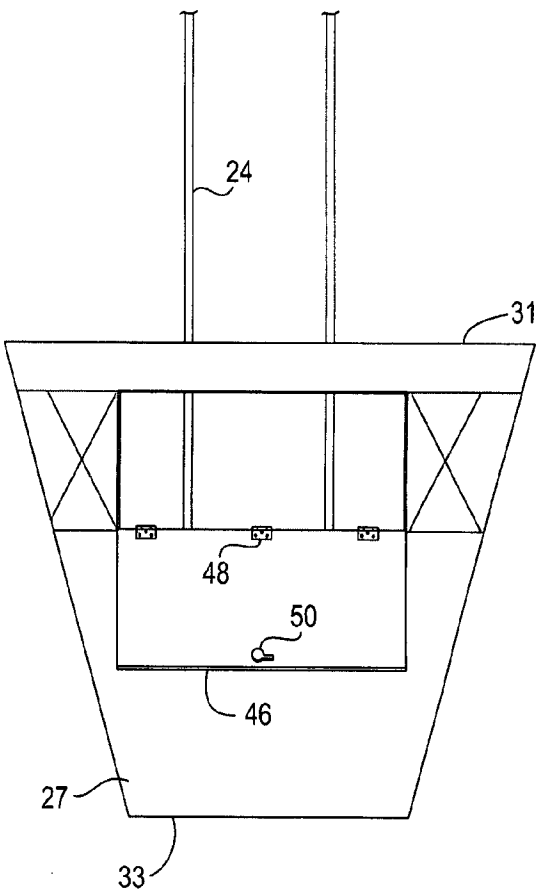
FIG. 5B is a sectional rear view of the display system base and a portion of the support tower of FIG. 1 with some of the bamboo style façade.
Figure 5A:
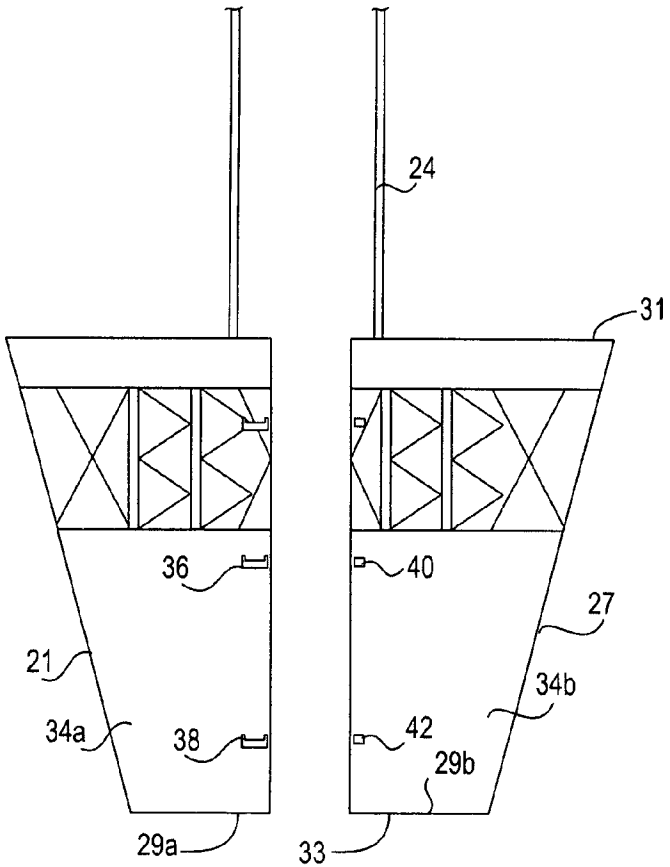
FIG. 5A is a sectional exploded view of the left side of the display system base and a portion of the support tower of FIG. 1 and without some of the bamboo style façade or connective truss sections.
Figure 6:
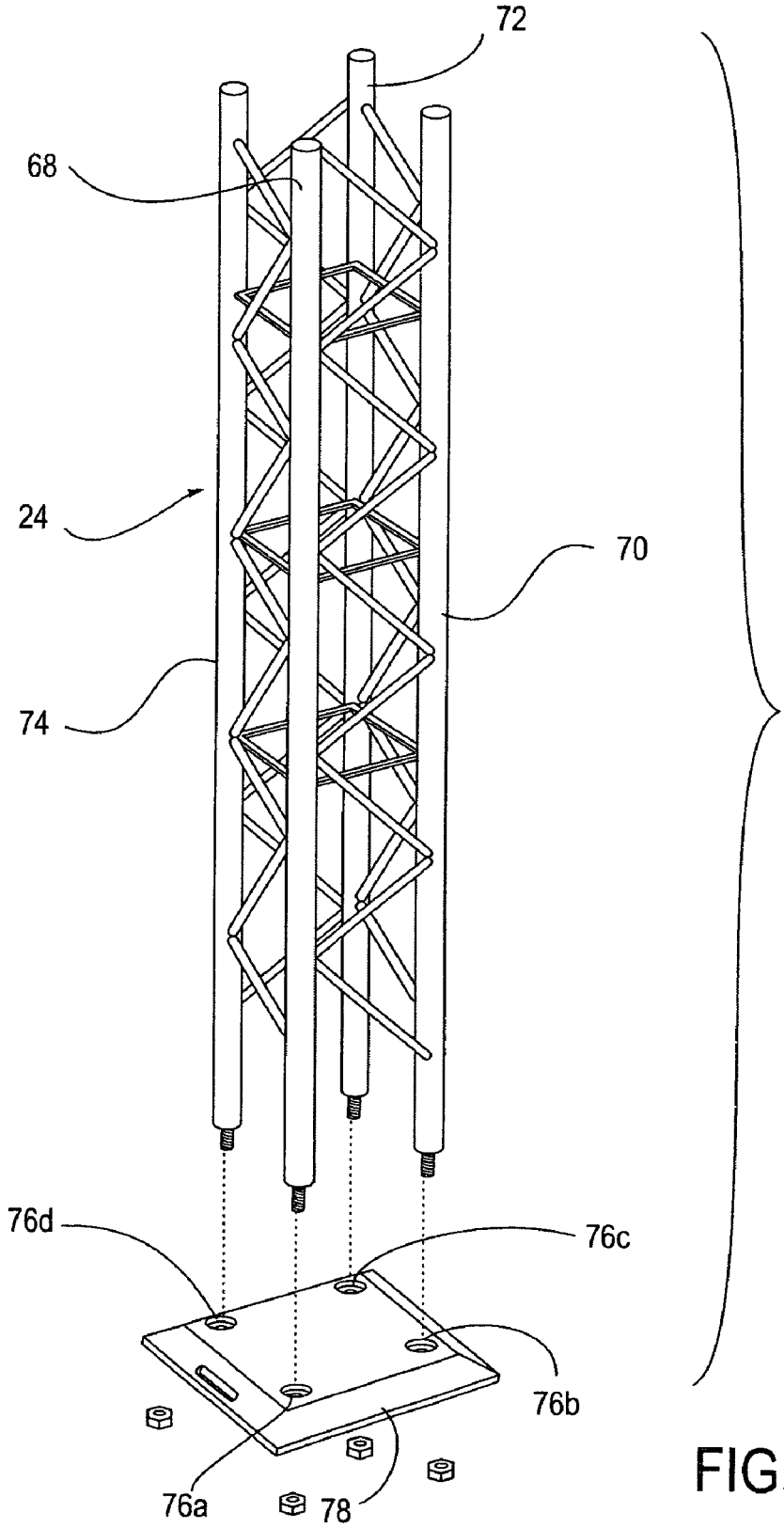
FIG. 6 is a forward left perspective view of the support tower of the display system of FIG. 1.
Figure 10:
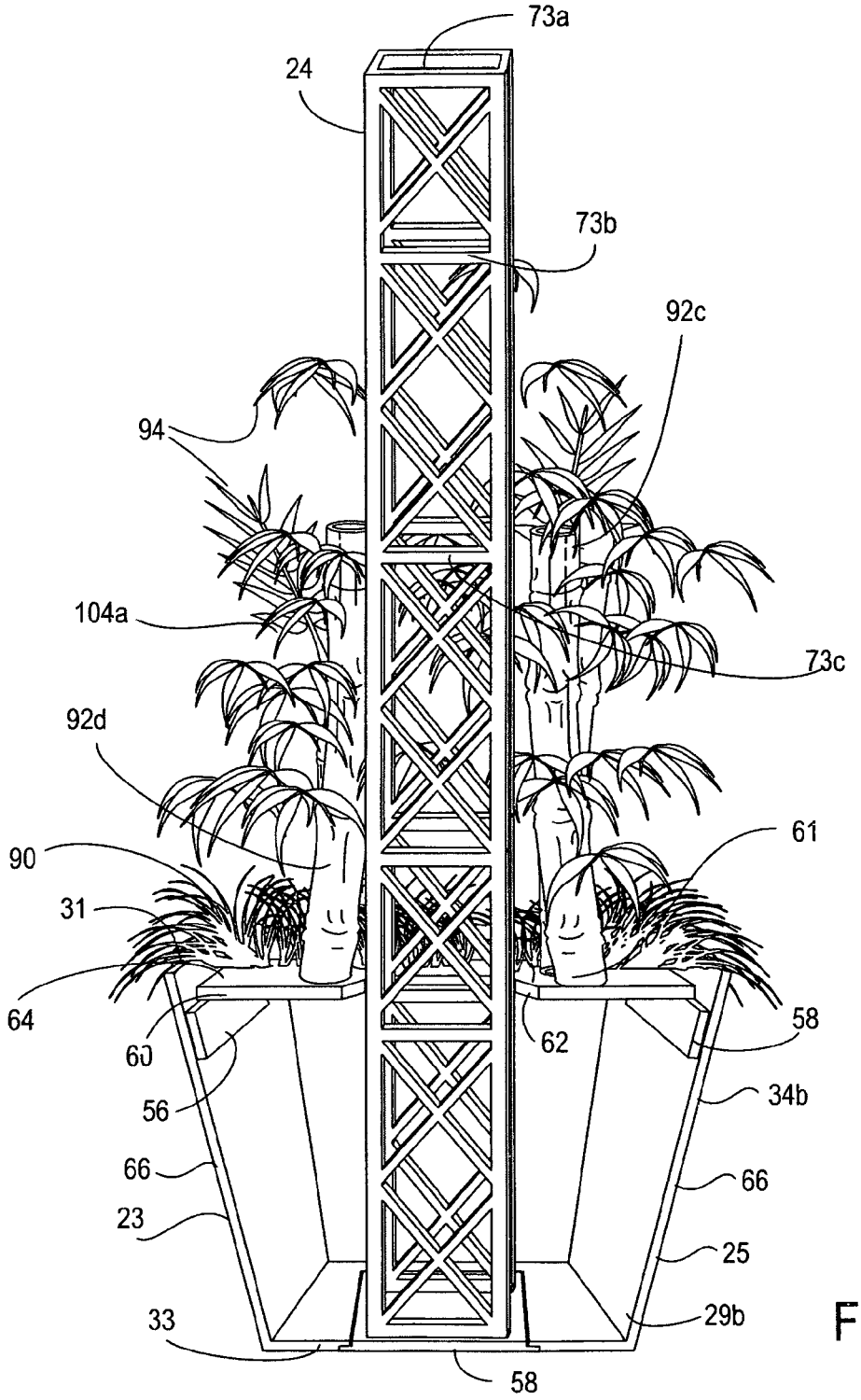
FIG. 10 is a view of the support tower of FIG. 1 with the display devices, display frame components, and front half of the base removed.

With reference to FIGS. 3, 4, 5A, and 5B, the base 22 of the display system 20 has the appearance of four trapezoidally shaped sides 21, 23, 25, and 27 joined at their respective corners to form a base that tapers inwardly from its top rim 31 to its flat bottom 33. However, the base, as shown in FIGS. 5A and 10, is formed by the mating of a two-piece shell having a front half 34*a* and a back half 34*b*. As an exemplary construction, the front half 34*a* includes a full side 21 joined to a pair of half-sides that form part of the left and right sides 23, 25, respectively. The bottom edges of these pieces are joined to a half-flooring 29*a*. The half-flooring includes a rectangular cutout or aperture for receiving one portion of the lowermost portion of the support tower 24. The back half 34*b* includes a full side 27 joined to a pair of half sides forming the complement of the left and right sides 23, 25 and joined to a half-flooring 29*b* with a complementary cutout as well and is otherwise identical to the left half 34*a* with the exception that the rear panel 27 includes an access door 46 (FIG. 5B) having a set of hinges 48 on its top side and a latch 50 or lock along the bottom side.

To mate the halves together and form the open-topped base shell 22 and electronic device enclosure for the bottom portion of the support tower 24, the front half 34*a* and back half 34*b* have complementary upper and lower fasteners 36, 38 and 40, 42, respectively. In this exemplary embodiment, the upper and lower front half fasteners 36, 38 are in the form of a hook or latch for fastening to the corresponding back half fasteners 40, 42 in the form of slots or eyehook receptacles. While shown in FIG. 5A as appearing on the outside of the shell, this is for the sake of explanation only and it is preferred to hide the fasteners on the interior of the base sides. In this exemplary embodiment, the base measures approximately twenty-four inches across its flat square bottom surface 33 and approximately forty-four to forty-eight inches across the square top rim 31.

As shown in the cutaway illustration of FIG. 10, the upper inside edges of at least two of the base walls 23, 25, respectively, include a ledge 56, 58, upon which a rectangular two-piece cover 60 rests. The position of the ledges ensures that the cover is recessed from the top rim 31 of the base when assembled. Each half of the cover has a central square cutout 62 to fit around the lower portion of the square support tower 24. The cutout provides an aperture for aligning the support tower in an upright position. The cover also provides an underlying support and attachment surface 64 for receiving concealing elements as discussed below in more detail. As shown in the FIGS. 1, 3, and 4, the outer surfaces of the base 22 can be covered in a decorative facing or façade 66. In this exemplary embodiment the facing has a bamboo motif. The facing may be a laminate adhered or otherwise suitably fastened to the outer surfaces of the base or the sides of the base may be molded to provide the desired appearance. The access panel 46 may be placed on any one of the sides and is not limited to the rear panel. Also, as an alternative to the half shell approach, one of the sides of the base may be a removable panel secured to its adjacent sides by suitable fasteners. This removable panel may include the access panel if desired.

The base 22 components may be made of wood, plastic, metal or other suitable material or combination of materials. Other suitable shapes such as those commonly used in planters or tower bases will occur to one of ordinary skill in the art. When assembled, the base is primarily used to provide a stable platform for the display tower 24 and conceal many of the electrical components used in the display system including the playback device 26. Such concealed components remain accessible via the rear access panel 46.

Referring now to FIGS. 6, 7A-7D, and 10, the support tower 24 provides a convenient mounting rack for several of the multi-media display system 20 components. The tower is preferably in the form of a square, open box truss having four uprights 68, 70, 72, 74 at the respective corners of the truss structure formed of two inch steel tubing. Spanning between the legs at regular two foot intervals are six sets of respective cross beams designated from top to bottom 73*a*, 73*b*, 73*c*, 73*d*, 73*e*, and 73*f*. As an exception to the cross beam spacing, the lowermost set of cross beams 73*f* is positioned along the height of the support tower approximately one foot below the adjacent upper shelf 73*e*. The cross beams are formed of one inch steel tubing in this exemplary embodiment. The truss further includes diagonal support braces such as that designated 75 (FIG. 10) for additional stability. It will be appreciated that this is an exemplary spacing and number of cross beams and not meant to be limiting.

Figure 7A:
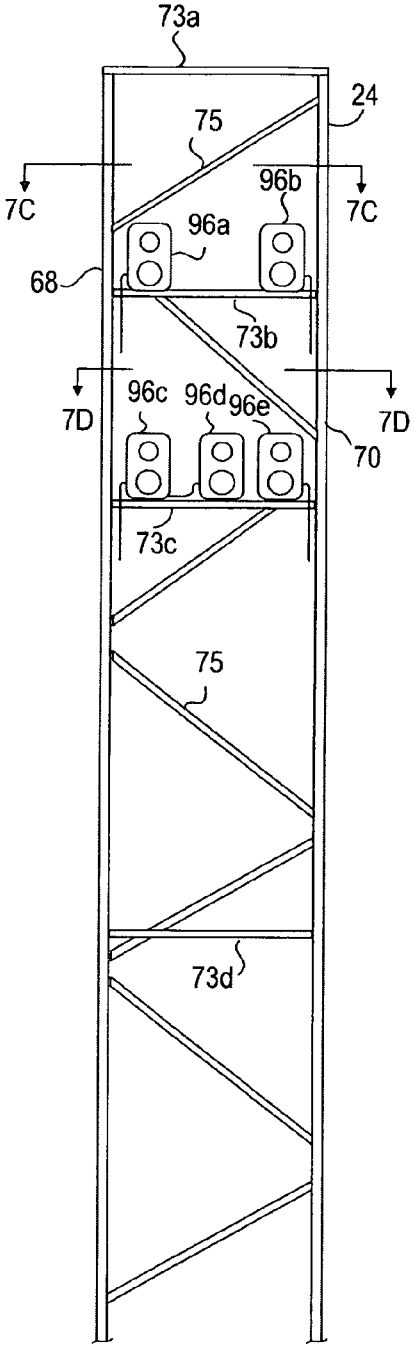
FIG. 7A is a sectional front view of the upper portion of the support tower of the display system of FIG. 1 with some exemplary components mounted thereon.
Figure 7C:
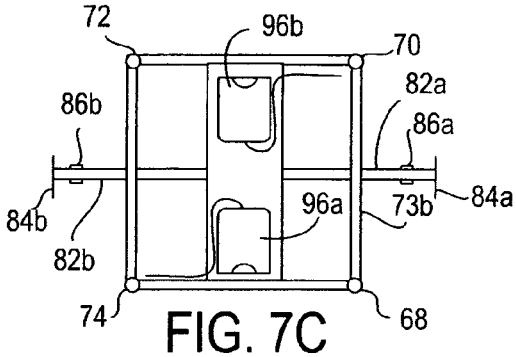
FIG. 7C is a top view of the support tower of FIG. 7A taken along lines 7C-7C and rotated through 90 degrees.
Figure 7D:
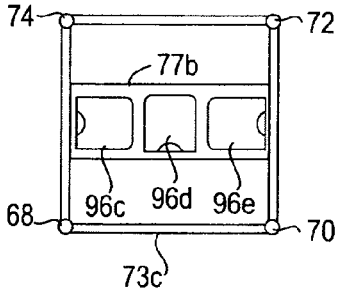
FIG. 7D is a top view of the support tower of FIG. 7A taken along lines 7D-7D.

Referring to FIGS. 7C, and 7D, spanning between opposing cross beams are six inch wide flat plate metal shelves or speaker plates 77*a*, 77*b* upon which electrical components such as speakers, surge protectors, and lamps may rest. Speaker plate 77*a* spans across two opposing cross beams of cross beam set 73*b*. Likewise, speaker plate 77*b* spans across two opposing cross beams of cross beam set 73*c*. The speaker plate for the subwoofer described below is hidden behind one cross beam of cross beam set 73*e* in FIG. 7B. An enlarged shelf (not shown) for supporting the playback device 26 is hidden behind one cross beam of cross beam set 73*f* in FIG. 7B. The enlarged shelf is preferably constructed to hold a device the size of a conventional DVD player. Additional plates may also be positioned on the remaining cross beam sets 73*a*, 73*d* if desired. It will be appreciated that the shelf sizes may vary according to suit the dimensions and number of the electrical components supported.

Referring back to FIG. 6, the lowermost ends of the uprights 68, 70, 72, 74 or legs include threaded posts for inserting into corresponding holes 76*a*, 76*b*, 76*c*, and 76*d* of the stabilizing plate 78. The box truss is secured to the plate by nuts coupling with the threaded posts. Alternatively, the truss may be welded to the stabilizing plate. Other suitable fastening or joining methods will occur to one of ordinary skill. In this exemplary embodiment, the square stabilizing plate measures two feet across. During assembly, the bottom surfaces of the front and back halves 34*a*, 34*b* of the base are slid over the stabilizing plate and rested thereon. The cutouts in the flooring halves allows the bottom surfaces of the base halves to butt up against the uprights of the support tower 24 and cover the stabilizing plate. When assembled, the weight of the base 22 on the stabilizing plate inhibits the support tower from rocking. In addition, the cutouts in the two piece cover 60 ensure that the cover halves abut right up against the support tower 24 and provide additional stability at a higher location along the length of the tower and also assist in aligning the tower in an upright position. If desired, the upper section of the tower may be angled to provide alternative display positions. In addition, the tower may be offset with respect to the base in which case the bottom surface aperture and cover aperture would be adjusted accordingly.

As shown in the FIG. 10, the support tower 24 includes a lower portion 80 extending through the cover 60 where it is concealed inside the base 22 and upper portion 81 for supporting the speakers above the base. The entire box truss may be welded together or otherwise suitably constructed. In this exemplary embodiment, the tower is formed of steel and measures approximately one foot in width and depth and nine feet in height. While the box truss has been found to be a preferred construction, it will be appreciated that other suitable truss shapes or support frames may be used including rectangular, triangular, circular shapes, and other well known geometric shapes. The upper section of the support tower may also include divergent branches for supporting multiple displays.

Figure 7B:
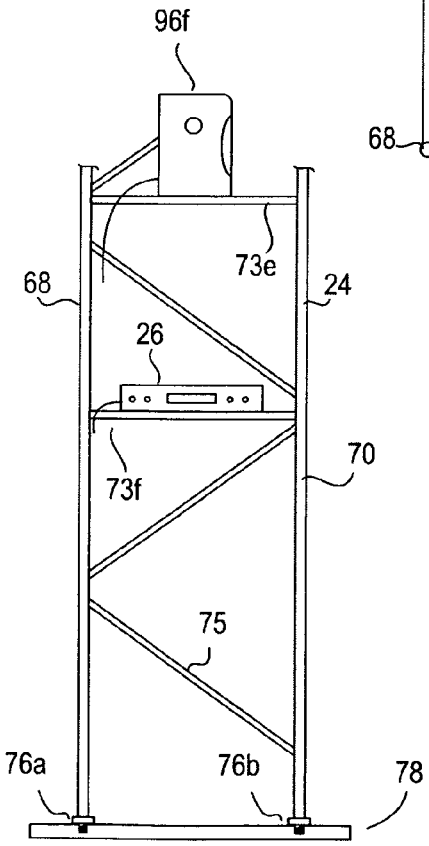
FIG. 7B is a sectional front view of the lower portion of the support tower of the display system of FIG. 1 with some exemplary components mounted thereon.

With reference to FIGS. 2 and 7B, the playback device 26 is supported on a tower shelf spanning between cross beam set 73*f* such that it is normally concealed within the base shell 22. The playback device 26 includes a conventional optical or magnetic drive 59 capable of reading a digital recording medium 51 and transmitting a video signal to the displays 30*a*, 30*b*. Preferably, the playback device has a loop feature for endless playback of the content on the digital recording medium. In this exemplary embodiment, it is preferred to use a conventional DVD player capable of decoding a conventional single or dual layer DVD, whether read only or re-recordable. Other suitable optical and magnetic storage and playback devices will occur to one of ordinary skill in the art. A computer with an optical disk or magnetic storage drive could be used to play back digitally recorded multi-media presentations.

For use in the playback device 26, the digital recording medium 28 is recorded with multi-media presentations such as advertisements, promos, and other marketing presentations or displays using conventional audiovisual recording techniques. By developing or obtaining advertising media relating to the locale in which the media display tower will be located, the locale's own advertising may be recorded onto the recording medium 28 and play on endlessly once the display system 20 is assembled and power provided. For locations such as malls having a common area, advertising from a number of different sources may be recorded on the recording medium 28 and alternately displayed on the display screens 30*a*, 30*b*. Given the capacity of the recording mediums 28, advertising can play for hours without repeating if desired. The preferable playback device 26 also includes a sound output system such as Dolby 5.1 Surround Sound or other recognized sound system for outputting the audio component of the multi-media recording to a surround sound system. The playback device includes a power cord 53 for plugging into the power source 32 or intermediate surge protector as do the other electrical components discussed herein.

With reference to FIGS. 1-3, the display device 30*a*, 30*b* can be a monitor, CRT television, projection screen, LCD, or conventional display screen capable of receiving a video and/or audio feed from the playback device 26. The preferable display device is a plasma screen or LCD television due to its thin profile, relatively low weight, and high definition broadcasting capability. A forty-two inch plasma screen has been found to provide suitable viewing dimensions for a media tower nine feet high.

Referring to FIGS. 4 and 7C, the display devices 30*a*, 30*b* are mounted to the upper end of the support tower 24 by a set of opposing mounting brackets 82*a* and 82*b* welded to and extending outwardly from the cross beams of the cross beam set 73*b* of the box truss to position the display devices at a location near the top of the support tower. Alternatively, a single beam could be supported by opposing cross beams and pass through and extend outwardly from the box truss. The respective outer ends of the mounting brackets 82*a*, 82*b* include a flat metallic plate 84*a*, 84*b* for coupling to the rear surface of the plasma screen television. This plate may either slide into a complementary mating receptacle on the back of the television as the television is lowered onto the plate or otherwise fastened to the plate using suitable conventional plasma screen mounting fasteners. For additional security, a locking element (not shown) may secure the television to the mounting bracket. Adjusting clamps 86*a*, 86*b* with release and tightening screws are provided in each bracket for adjusting the tilt of the television. In this example, the horizontal centerline of the plasma screen televisions are supported approximately eight to nine feet in the air. While only one display device is needed and may be preferred depending on the location of the media display system such as up against a wall, two offsetting display devices may also be preferred to counter each other's weight on the tower if the locale warrants such usage.

Referring to FIG. 2, if more than one display device 30*a*, 30*b* is used, a component video splitter 88 having a single input/dual output capability is connected between the display devices and the playback device 26. This allows the same image to be displayed on both display devices at the same time.

Alternatively, instead of a standalone display system 20 wherein all video and audio content is self-contained in a playback device concealed in the base 22, the audio and video signals may be provided by a remote content creation source located outside the base and transmitted to the display device using a wired or wireless connection. For example, audio visual content may be created at a remote location using a conventional recording program and downloaded over a network such as the Internet or local network and transmitted to a local server or workstation. The server may then forward the audio visual signals to a wireless receiver in the base 22 of the display system 20, which in turn transmits the signals to the audio and display devices for playback. A wired connection between the audio and display devices and the server may be used instead of a wireless receiver. Any conventional networking system capable of transmitting audio visual signals to the display and audio components of the display system may be used. The audio visual content to be output by the display system 20 may either be pre-recorded or live streaming content continuously refreshed.

The power source 32 (FIG. 2) for the electrical components used in the display system 20 is preferably a conventional and conveniently located wall outlet operating on an active AC voltage source. However, it will be appreciated that other sources of power such as a battery or a solar cell power source could be used to make the display system completely self-contained. A battery power source could be concealed within the tower base 22 and the top of the support tower 24 also provides a convenient mounting surface for a solar panel assuming the display tower is located in an area exposed to sunlight for a suitable portion of the day.

Referring now to FIGS. 1-4, 7A-D, 8A-D, 9, and 10, in addition to the features set forth above, several optional components may be integrated into the multi-media display system 20 adding to the overall presentation capability and appearance of the display system. These components include multiple concealment features such as a base cover concealer 90, imitation stalks 92*a*, 92*b*, 92*c*, 92*d*, and foliage, generally designated 94. Other optional components include a surround sound speaker system 96*a*, 96*b*, 96*c*, 96*d*, 96*d*, 96*e*, and 96*f*, static display panels 98*a*, 98*b*, and backlighting components 100*a*, 100*b*, 100*c*, 100*d*.

The concealment features, while capable of varying greatly in form to blend into the surrounding environment or motif, inhibit the theft of costly electrical equipment and provide a pleasing aesthetic appearance to the media display system 20. By selecting the proper concealment features, the media display system may be made to appear to generally blend into its surroundings while not obscuring the display devices 30*a*, 30*b*. One such concealment feature is the base cover concealer 90 (FIGS. 1, 3, 4, and 10) that lies on the underlying surface 64 of the base cover 60. In this exemplary embodiment, the cover concealer is in the form of a long grass lawn and substantially hides the cover and surrounds the truss structure near the cover. The recessed cover 60 or a flush cover may also provide a shelf or a bin for loose concealment accessories such as apparel, clothing accessories, and other consumer products to further disguise the tower.

Further concealment components include a set of imitation stalks 92*a*, 92*b*, 92*c*, and 92*d* (FIGS. 1, 3, 4, and 10) that may be fixed or removably coupled to the cover using conventional fasteners or mounted to the support tower 24 or held in place with a rigid foam material placed on the cover 60 and underneath the base cover concealer 90. For example, the cover may include pre-drilled holes for receiving a corresponding threaded fastener projecting from the bottom of each imitation stalk. In this example, the imitation stalks have a bamboo motif. Additional greenery or foliage 94 is mounted on the imitation stalks or truss structure using adhesives, threaded fasteners, wiring, or other suitable mounting device and may be used to conceal the truss and electrical components further. A top central stalk 102 (FIG. 3) or topper with additional foliage 94 may project from the top of the truss structure and provide cover from above. The topper could also include more than one imitation stalk mounted about different sides of the support tower. Clever combination of these concealing elements can hide much, if not all, of the truss structure, electronic components, and associated wiring, without obscuring the display screens. Concealment features may be selected from other types of known flora or may be structures such as imitation columns or the like to conceal the support tower 24 and generally selected to blend into the surrounding environment. Another example would be the use of the two-piece tree trunk-like shell with corresponding foliage to surround the support tower and disguise the electronic and structural components of the display system as long as the display screens 30*a*, 30*b* remain visible. In addition to the flora motif, other artificial structures may be used. Examples include shoe trees, mannequins, storage boxes and shelves, athletic equipment, produce, and other consumer products. Other suitable concealment features will occur to one of ordinary skill to conceal the tower components other than the display devices and still blend the display system 20 into the surrounding environment. The concealment features are preferably removably coupled or otherwise attached to the upper surface of the cover 60 and tower surface using suitable fastening devices so that adjustments may easily be made and also to provide multiple assembly variations. Concealment features may also be placed about the exterior of the base 22 if desired.

With reference to FIG. 2, the speaker system is preferably a Dolby Digital 5.1 surround sound system including at least five speakers 96*a*, 96*b*, 96*c*, 96*d*, 96*e*, and a sub-woofer 96*f* dispersed throughout the support tower 24 to play audio signals transmitted from the playback device 26. As shown in FIGS. 7A-7D, the speakers may be placed on the shelving 77*a*, 77*b* provided between each set of cross beams 73*b*, 73*c*, respectively. In this example, the rear projection speakers 96*a*, 96*b* are placed on the upper tier shelf 77*a* (FIGS. 7A, 7C) while the forward projection speakers 96*c*, 96*d*, 96*e* are placed on the second tier shelf 77*b*. The subwoofer 96*e* is located on second tier 77*e* from the bottom generally at about cover 60 height. Referring again to FIG. 2, the speakers and subwoofer are connected to the rear panel of the playback device using conventional wiring. Alternatively, to reduce some of the wiring requirements of the display system 20, a wireless connection between the playback device 26 and speakers could be used with the speakers incorporating a self-contained power source such as a battery. The speakers may also be connected directly to the truss structure using conventional mounting brackets or other suitable fasteners instead of residing on shelving.

Figures 8A, 8B, 8C, 8D:
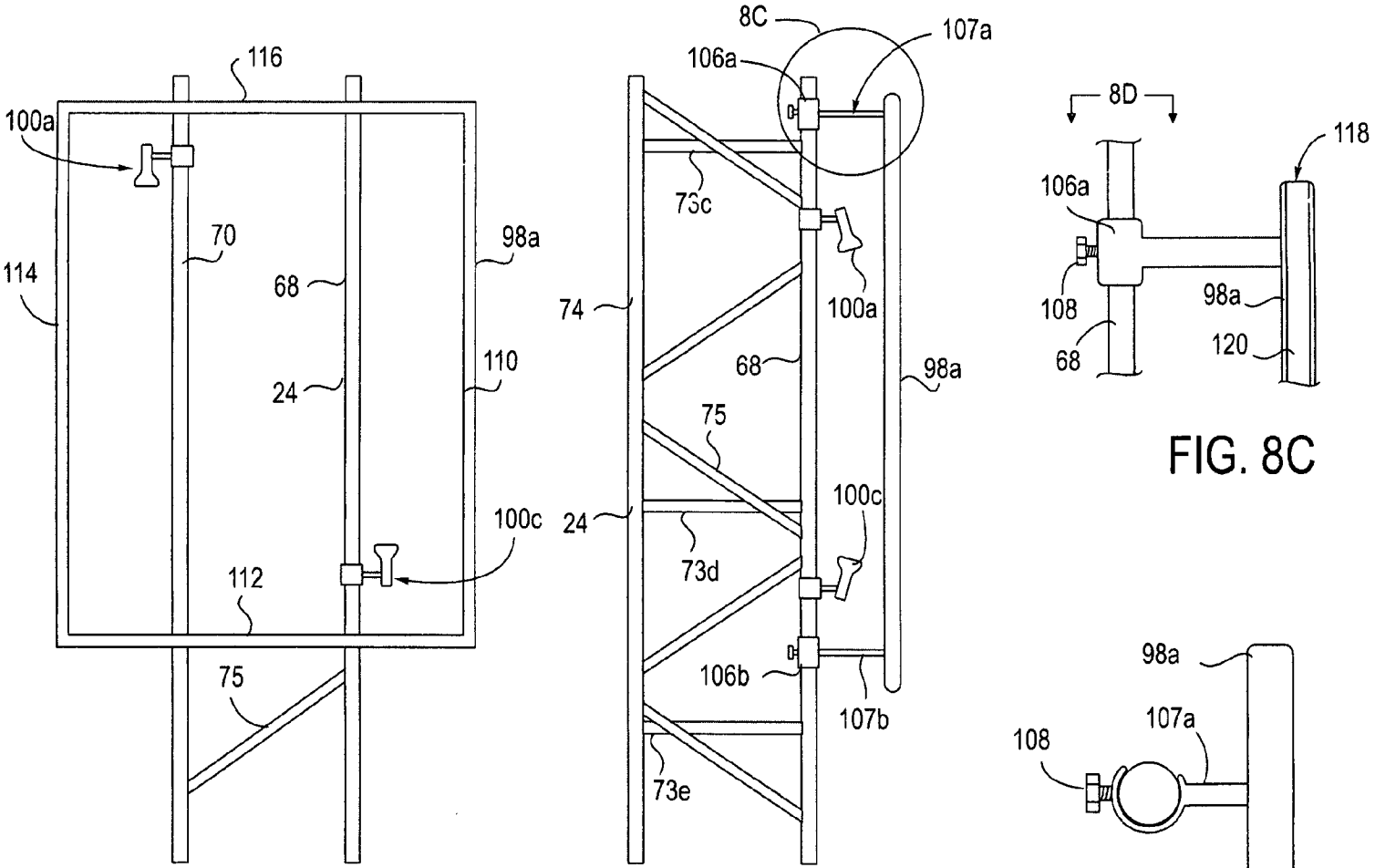
FIG. 8A is a close up sectional rear view of the display frame and light mounting components on the support tower of the display system of FIG. 1.
FIG. 8B is a close up sectional side view of the display frame and light mounting components of FIG. 8A.
FIG. 8C is a close up sectional view of the display frame mounting device of FIG. 8B taken from oval 8C.
FIG. 8D is a top view of the display frame mounting device taken along lines 8D-8D of FIG. 8C.
Figure 9:
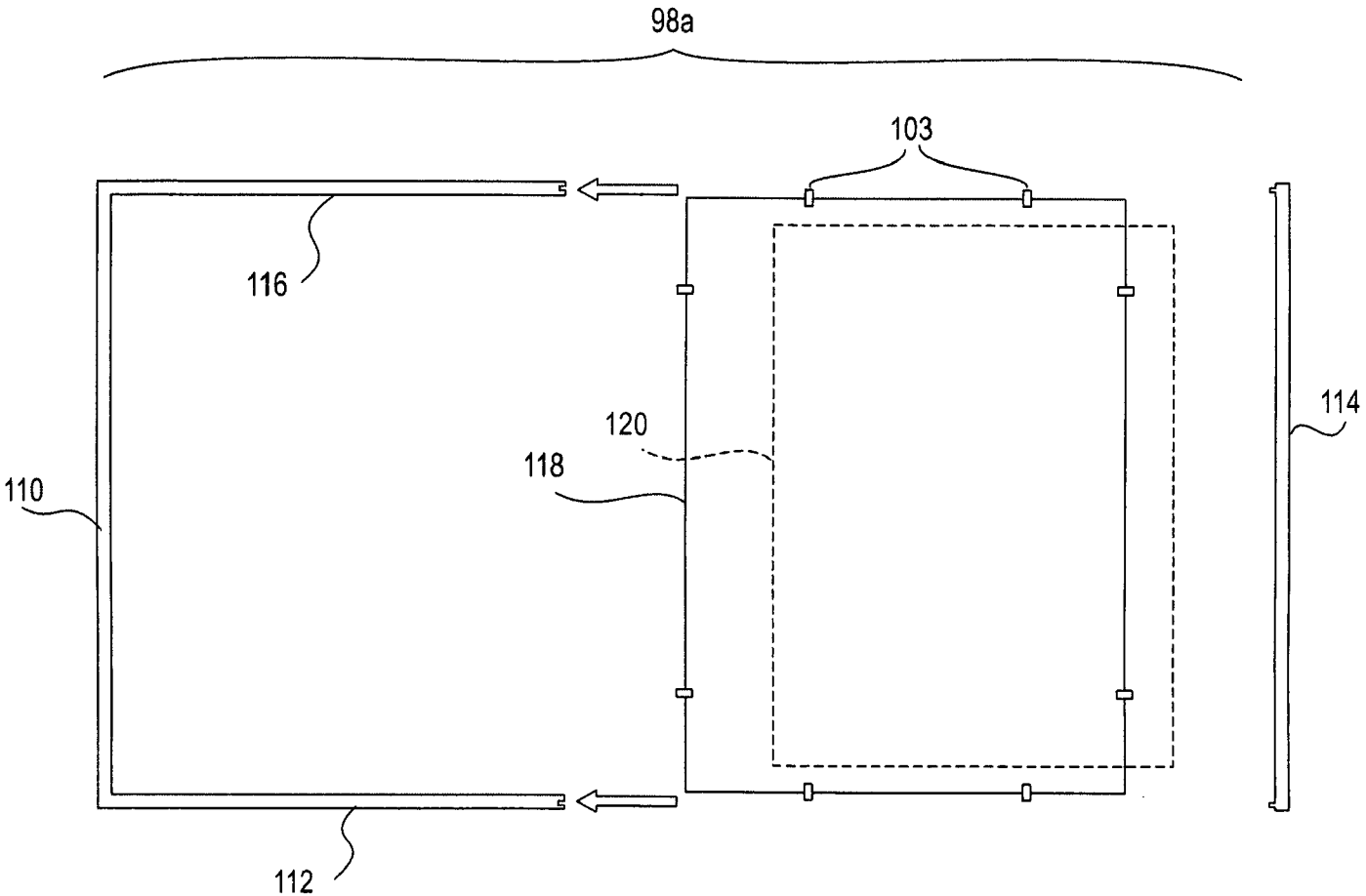
FIG. 9 is an exploded view of the display panel system of FIG. 1.

Referring now to FIGS. 8A-8D and 9, an exemplary static display panel 98*a* includes a frame 104*a* mounted to two consecutive legs 68, 70 of the support tower 24 using a set of upper and lower sliding clamps 106*a*, 106*b*. Each clamp may be fixed in position with a set screw 108 and includes a short extension 107*a*, 107*b* to position the display frame out away from the support tower. The frame 104*a* of the display panel has four slotted sides 110, 112, 114, 116 for receiving a pair of transparent glass, plexi-glass, or plastic panels 118 and a poster 120 or other enlarged and substantially flattened advertising material sandwiched therebetween. Clips 103 (FIG. 9) may be used to hold the dual clear panels together and prevent the poster from slipping. One side 114 of the frame of the frame is removable (FIG. 9). One end of each poster frame may be hinged so that access to the poster is obtained by folding back the hinged end of the frame and sliding the poster in and out of the frame. In this exemplary embodiment, the right side of the frame is mated to the free ends of the frame extensions using conventional clips or interference fit bosses that fit into the hollow ends of the frame. By removing the right side of the frame, the advertising material and clear panels may be slipped between the frame sections as a unit or removed and exchanged. The display frames measure approximately twenty to thirty inches in width by forty to forty-eight inches in height in this exemplary embodiment. However, it will be appreciated that different sized display frames and that either a single or more than two display frames may be used. In addition, in the example, the display frames are mounted at ninety degree angles to the display screens 30*a*, 30*b* but other suitable angles will occur to one of ordinary skill in the art. The opposing static display panel 98*b* is constructed similarly to the panel system 98*a* and like components are numbered alike where shown.

With continued reference to FIGS. 8A and 8B, backlighting of the static display panels 98*a*, 98*b* is provided by a pair of upper lamps 100*a*, 100*b* and a pair of lower lamps 100*c*, 100*d*. Each lamp includes a generally C-shaped clamp 122 for securing the lamp to the truss structure and a power cord for plugging into a power strip or other power source. The lamps may also be bolted or otherwise secured directly to the truss and may be located within the confines of the truss structure. The lamps are positioned behind their respective display frames to backlight the poster within the frame. In addition to backlighting the static displays, the lamps also provide ambient light for the foliage and other concealment features to add to the overall pleasing appearance of the display system. The lamps are preferably selected with low heat producing bulbs or LEDs to protect the surrounding concealment features and display panels. With the addition of the display frames, the media display system 20 incorporates the capabilities of both static and transitional advertising displays. Turning to FIG. 2, due to the number and nature of the electrical components used in the display tower 20, at least one surge protector 124*a*, 124*b* may be used. In this example, the two display screens 30*a*, 30*b* and upper backlighting components 100*a*, 100*b* are plugged into a first surge protector 124*a* while the playback device 26 and lower backlighting components 100*c*, 100*d* are plugged into a second surge protector 124*b*. The surge protectors may then be plugged into the power source 32 and turned on to supply power to the electrical components of the media display system 20.

Turning to FIGS. 1-3 and 10 and assuming the media display system 20 is to be assembled with two display screens 30*a*, 30*b*, surround sound system 96*a-f*, two display panel systems 98*a*, 98*b*, and four backlighting lamps 100*a*, 100*b*, 100*c*, 100*d*, and will include concealment features, a locale is initially selected for the multi-media display system 20. Upon reaching an agreement with the locale owner as to the type of advertising that will appear on the display screens 30*a*, 30*b* and what type of concealment features 90, 92, 94 and outer façade 66 are suitable for conforming to the locale's environment, the assembly and advertising production may begin. Using conventional methods, the advertising spots or other promotional content are recorded onto a suitable digital recording medium 28. Similarly, the posters 120 are imprinted using conventional techniques with the desired advertising. The multi-media display system 20 components are then delivered to the locale to be assembled.

The support tower 24 may be situated in an upright position in the desired location near a wall or away from any walls where 360 degree viewing may take place and the display screens 30*a*, 30*b* mounted to their respective mounting brackets 82*a*, 82*b*. The playback device 26 and speaker system components 96*a-f* are placed on the appropriate tower shelves and wired together, as necessary by the assembler. The two halves 34*a*, 34*b* of the base shell 22 may be slid on top of the stabilizing plate 78 and mated together by the assembler. The static display frame 98*a*, 98*b* are mounted to the desired support tower uprights at a preferred location using the sliding clamps 106*a*, 106*b* and tightened in place and then may be loaded with the advertising posters 120. The lamps 100*a*, 100*b*, 100*c*, and 100*d* are likewise clamped to the support tower 24 by the system assembler. All electrical components may be connected together as in FIG. 2. The concealment features 92*a-d* are secured to the cover 60 or truss 24 and the cover concealer 90 is placed over the cover and about the stalks. The foliage 94 is added to the stalks and truss where desired. Pre-constructed foliage holders such a plastic clamps, clips, or pre-drilled holes about the support tower and imitation stalks for insertion into such holders may be used to facilitate this process. The topper 102 may be added as well. The façade 66 is coupled to the sides 21, 23, 25, and 27 of the base 22 if not previously attached or formed into the sides of the base.

With the media display system 20 in position, the electrical components wired together, and the system assembled to the desired appearance, the power cord 126 is plugged into a nearby power source 32. It will be appreciated that the power source may come from a conventional wall, floor, or ceiling outlet. The rear access panel 46 may be unlatched by the operator and raised up to access the playback device 26 inside the base 22. The surge protectors 124*a*, 124*b* may be switched on to turn on the lighting components 100*a*, 100*b*, 100*c*, and 100*d* and backlight the display frames 104*a*, 104*b*. The DVD player 26 may then be activated and loaded with the multi-media DVD 28. The operator may press the play button on the DVD player and the endless loop button if desired. The access panel 46 is closed and latched. The programmed advertising on the DVD is played back on both display screens 30*a*, 30*b*. The tilt angle of the display screens may be adjusted by loosening the clamps 86*a*, 86*b*, adjusting the tilt angle of the screen, and re-tightening the clamps. As long as power is supplied to the media system 20, the advertising will continue to display as determined by the pre-recording on the digital recording medium 28 and will be accompanied by the recorded audio component, if any. In addition, a conventional plug-in timer could be used to activate and deactivate the multi-media display system 20 in accordance with locale operating hours. If a remote content system is used, the remote system is actuated to begin providing content to the display devices.

It will be appreciated that it is a relatively routine matter for an operator to visit the locale and exchange a new DVD 28 via the access panel 46 or change the display frame posters 120 to update or change the advertising. In addition, if the media system 20 is to be moved, the reversal of the above described assembly steps provide for a rapid disassembly of the system components for ready transport to another location. The system 20 is constructed so that a single individual may set up or disassemble the system.

It will be appreciated that commonly used constructions and concealment themes may be prefabricated and ready for delivery. Also, while the façade 66 may be used to further blend the display system 20 into the surrounding environment, such façade may incorporate further additional static advertising. It will be appreciated that the display system is constructed to appear either up against a wall or in the middle of a room with 360 degree viewing. The concealment features facilitate such placement by removing from view any structural components such as the truss and electrical wiring that may not blend into the surrounding environment. The access panel is also preferably constructed to blend into the overall base panel theme and difficult to spot from a relatively close distance.

While the present invention has been described herein in terms of a number of preferred embodiments, it will be appreciated that various changes and improvements may also be made to the invention without departing from the scope and spirit thereof. Variances of the assembly steps will occur to those of ordinary skill in the art as well. The dimensions discussed herein are not meant to be limiting and smaller or larger scale media display systems fall well within the scope of the present invention.

What is claimed is:

1. A multi-media display system comprising:

a substantially hollow base section with an uppermost rim defining an opening and an opposing bottom surface for resting on a support surface;

a cover spanning said opening of said base section and cooperating with said base section to define an enclosure, said cover including an alignment aperture and an upper surface including a first attachment surface;

an elongated support tower with a lower section and an upper section, said tower projecting through said alignment aperture to position said lower section within said enclosure and said upper section in a substantially upright position and providing a second attachment surface;

a mounting bracket projecting from said upper section;

a display device supported from said mounting bracket and operable to display video images;

an audio visual signal processing unit concealed in said enclosure, said unit operable to transmit a video signal to said display device to display an image corresponding to said video signal; and a concealment feature coupled to at least one of said attachment surfaces and concealing a portion of said tower.

2. A multi-media display system as set forth in claim 1 wherein:

said lower section of said tower terminates in an enlarged flange; and said bottom surface of said base includes a second aperture surrounding a perimeter of said lower section of said tower with said bottom surface having an outermost surface resting on said flange to maintain said tower in an upright position.

3. A multi-media display system as set forth in claim 1 further including:

at least one audio output device supported from said tower and operable to output audio signals received from said audio video signal processing unit.

4. A multi-media display system as set forth in claim 1 further including:

at least one light source supported from said tower and operable to output light upon activation.

5. A multi-media display system as set forth in claim 1 wherein:

said cover includes two members with complementary cutouts defining said alignment aperture, said members being supported by said base and recessed below said upper rim.

6. A multi-media display system as set forth in claim 1 wherein:

said base includes complementary sections coupled together about said lower section of said tower.

7. A multi-media display system as set forth in claim 1 further including:

said base includes an access door.

8. A multi-media display system as set forth in claim 1 wherein:

a plurality of concealment features are removably coupled to said first and second attachment surfaces without obscuring said display device.

9. A multi-media display system as set forth in claim 1 wherein:

said base includes an outer surface having a portion thereof covered by a removable façade.

10. A multi-media display system as set forth in claim 1 further including:

a self-contained power supply supported from said tower and positioned within said enclosure, said power supply being coupled to said display device.

11. A multi-media display system as set forth in claim 1 wherein:

said mounting bracket for said display device is adjustable.

12. A multi-media display system as set forth in claim 1 further including:

a cover concealer resting atop said upper surface of said cover.

13. A multi-media display system as set forth in claim 1 wherein:

said tower is in the form of an open truss.

14. A multi-media display system as set forth in claim 1 wherein:

a plurality of concealment features in the form of artificial plants are removably coupled to said first and second attachment surfaces.

15. A multi-media display system comprising:

a substantially hollow base section with an uppermost rim defining an opening and an opposing bottom surface for resting on a support surface;

a cover spanning said opening of said base section and cooperating with said base section to define an enclosure, said cover including an alignment aperture and an upper surface including a first attachment surface;

an elongated support tower with a lower section and an upper section, said tower projecting through said alignment aperture to position said lower section within said enclosure and said upper section in a substantially upright position and providing a second attachment surface;

a mounting bracket projecting from said upper section;

a display device supported from said mounting bracket and operable to display video images;

a concealment feature coupled to at least one of said attachment surfaces and concealing a portion of said tower; and at least one static display panel supported from said tower between said display device and said cover.

16. A multi-media display system as set forth in claim 15 further including:

a static image placed within said static display panel; and at least one backlighting source supported by said tower and operable to project light against a back side of said static image upon activation.

17. A multi-media display system as set forth in claim 15 wherein:

said static display panel includes an outward facing wall having a viewing window and an inward facing wall, said walls being bounded by a frame with at least one openable side and spaced apart to receive a static image.

18. A multi-media display system comprising:

an elongated support tower in the form of a box truss having a lower section terminating in an enlarged laterally projecting stabilizing plate and an upper section having a set of adjustable mounting brackets at an uppermost distal extent, said truss including a plurality of shelves;

a pair of display devices coupled to said mounting brackets at opposing positions on said upper section of said tower, said display devices being operable to receive a video signal and display moving images;

an audio visual processing device resting on one of said shelves within said lower section and operable to transmit video signals to said display device;

a concealing shell including a first section and a complementary second section, said sections cooperating to define a base section with an upper rim with a recessed retention lip and an opposing bottom section with a flattened base, said shell sections resting on said stabilizing plate to maintain said support tower in an upright position and further cooperating to enclose said lower section of said tower and conceal said processing device, at least one of said shell sections further including an access door for accessing said processing device;

a cover resting on said recessed retention lip of said shell and including a cutout through which said tower projects therethrough, said cover further including a concealment covering feature resting thereon;

at least one static image display frame coupled to said tower and positioned between said rim of said shell and said display devices; and a set of predetermined artificial concealment features removably coupled to said cover and said tower to at least partially conceal said tower.

19. A multi-media display system comprising:

a base section defining an enclosure with an uppermost recessed surface having an alignment aperture and an opposing bottom surface for resting on a support surface and defining a second aperture;

an elongated support tower with a lower section terminating in an enlarged flange and an upper section, said tower projecting through said apertures to position said lower section within said enclosure with said bottom surface resting atop said flange to maintain said upper section in a substantially upright position;

a mounting bracket projecting from said upper section operable to support a display device from said support tower;

at least one static display panel supported from said tower between said mounting bracket and said recessed surface; and a plurality of concealment features removably coupled to said tower and said recessed surface concealing a substantial portion of said tower.

* * * * *